US005611713A

United States Patent [19]

Takeuchi

[11] Patent Number: 5,611,713

[45] Date of Patent: Mar. 18, 1997

[54] WRONG INSERTION PREVENTION STRUCTURE FOR A TERMINAL

[75] Inventor: Kunihiko Takeuchi, Kosai, Japan

[73] Assignee: Yazaki Corporation, Tokyo, Japan

[21] Appl. No.: 520,670

[22] Filed: Aug. 29, 1995

[30] Foreign Application Priority Data

Aug. 30, 1994 [JP] Japan ..... 6-205156

[51] Int. Cl.[6] ..... H01R 13/42

[52] U.S. Cl. ..... 439/752.5

[58] Field of Search ..... 439/752.5, 733.1, 439/682

[56] References Cited

U.S. PATENT DOCUMENTS

| | | | |
|---|---|---|---|
| 4,529,260 | 7/1985 | Smith | 439/682 |
| 5,195,913 | 3/1993 | Shattuck | 439/752.5 |
| 5,378,170 | 1/1995 | Abe et al. | 439/752.5 |

FOREIGN PATENT DOCUMENTS 63-159281 10/1988 Japan .

*Primary Examiner*—Gary F. Paumen

*Attorney, Agent, or Firm*—Armstrong, Westerman, Hattori, McLeland & Naughton

[57] ABSTRACT

Terminal having an interfering projection 4 for preventing a wrong insertion of a coupling terminal 3 is formed in a terminal accommodating section 2 of an upper casing 1, whereby the terminal 3 is received in a gap 12 between a resilient contacting portion 10 and a peripheral wall 11 of the terminal when the terminal is inserted in a proper orientation, while the terminal abuts against the interfering projection 4 when inserted in a wrong orientation. The resilient contacting portion 10 is further provided with a male tab contacting portion 15 having a slanted piece 13 which is bent near the upper end (namely upper bent end) **10*a* of the rear wall of the peripheral wall and slanted downward, and a busbar contacting portion 16 which is a continuation from the male tab contacting portion 15 and bent in the lower center portion (namely lower bent end) 10*b* of the peripheral wall to extend upwards therefrom, wherein the interfering projection 4 enters into a space 12 between the slanted portion and the front wall 11*a* of the peripheral wall 11 when the terminal 3 is properly inserted, and abuts against the upper or lower bent end of the resilient contacting portion 10** when not inserted properly.

4 Claims, 7 Drawing Sheets

WRONG INSERTION PREVENTION STRUCTURE FOR A TERMINAL

BACKGROUND OF THE INVENTION

1. Field of the Invention

The present invention relates to a structure for preventing a wrong insertion of a terminal into a terminal accommodating section in an electrical junction box or the like.

2. Description of the Prior Art

FIG. 10 is an exploded perspective view showing a conventional electrical junction box, wherein the junction box is composed of an upper casing 31 and a lower casing 32 respectively made of a synthetic resin material, together with a female coupling terminal 33 to be inserted into the upper casing 31 and a male terminal 34 to be inserted into the lower casing 32, and also a busbar 35 to be accommodated within the upper casing 31.

On the back surface of the upper casing 31, protrudedly provided are a terminal accommodating section 36 formed in a substantially rectangular tube shape for accommodating the coupling terminal 33 and a busbar receiving section 38 forming a groove 37 therein for receiving the busbar 35 and interconnecting the mutually adjacent terminal accommodating sections 36, 36. The coupling terminal 33 comprises an external peripheral wall 39 forming a substantially rectangular tube, which wall is further formed with a busbar receiving groove 40 for receiving the above busbar 35 and also a resilient contacting portion 41 (refer to FIG. 11) therein to be mated with the male terminal 34. The resilient contacting portion 41 is formed such that it is bent down inwardly near the upper end surface side of the wall 39, and further having a male tab contacting portion 42 to be contacted with the male terminal 34 and a busbar contacting portion 43 to be contacted with the busbar 35.

The busbar 35 is inserted and accommodated in the busbar receiving groove 37 of the upper casing 31, and enters inside the groove 40 of the coupling terminal 33 accommodated in the terminal accommodating section 36 so that it is connected with the busbar contacting portion 43. The male terminal 34 is inserted in a terminal receiving section 44 formed on the lower casing 32 with a male tab section **34*a* formed at the free end thereof protruded from the lower casing 32, which is to be brought into contact with the male tab contacting portion 42 of the coupling terminal 33, when the upper and lower casings 31, 32** are mutually fitted.

FIGS. 11 and 12 show a state in which the coupling terminal 33 is inserted in the terminal accommodating section 36. In the figures, it is shown that an overlapped portion 45 is formed at one side of the peripheral wall 39 of the coupling terminal 33 for the purpose of reinforcing the peripheral wall 39, and a relief groove 46 is formed in a notch-like shape for receiving the overlapped portion 45, whereby the orientation of the coupling terminal 33 is regulated only by inserting the overlapped portion 45 in the relief groove 46, and the coupling terminal 33 is prevented from coming off by inserting the busbar 35 into the grooves 37 and 40, respectively of the upper casing and the coupling terminal.

With the construction above, however, if a space gap between the coupling terminal 33 and the terminal accommodating section 36 happens to be made larger than the standard size because of the inconsistency of the manufactured dimensions thereof, the coupling terminal 33 can be accidentally accommodated in the terminal accommodating section 36, as shown in FIG. 13, even in a situation that the coupling terminal is rotated in the peripheral direction thereof as the overlapped portion 45 happens to be accommodated in the above inconsistent space gap, resulting that the busbar 35 and the male terminal 34 are improperly connected as a matter of fact.

In order to solve this problem, it can be arranged such that the peripheral wall 39 of the coupling terminal 33 is formed with a projecting portion 47, as indicated by a chain line in FIG. 13, and the accommodating section 36 of the upper casing 31 is formed with a fitting groove 48 for receiving the projecting portion 47. However, since such an additional member as the projected portion 47 has to be provided, an yield of the material prepared for manufacturing the coupling connector is deteriorated, and also a coupling terminal is often entangled with another adjacent terminal, thus making it difficult to handle them. Still further due to the fact that the fitting groove 48 is protrudedly formed, the space within the electrical junction box is also reduced as a whole, thereby deteriorating the distribution efficiency of the circuits or the like as well.

SUMMARY OF THE INVENTION

The present invention has been made to solve the above-mentioned problems, and accordingly, it is an object of the present invention to provide a structure for preventing a wrong insertion of a terminal which is capable of leading a secure insertion of a terminal with its proper orientation into a terminal receiving member, yet without deteriorating an yield of the material prepared for manufacturing the terminal, handling efficiency, and without reducing a distribution space within an electrical junction box.

In order to accomplish the above objective, a wrong insertion prevention structure for a terminal according to the present invention for leading a terminal formed with a peripheral wall of a substantially rectangular tube and having a resilient contacting portion therein into a corresponding terminal accommodating section formed in an electrical junction box or the like is based on a construction such that the terminal accommodating section is further formed with an interfering projection, wherein the projection enters into a space between the resilient contacting portion and the peripheral wall when the terminal is properly inserted, and abuts against the resilient contacting portion when the terminal is not inserted properly.

Further, it can also be constructed such that the resilient contacting portion is further provided with a male tab contacting portion having a slanted piece which is bent near the upper end (namely upper bent end) of the rear wall of the peripheral wall and slanted downward, and a busbar contacting portion which is a continuation from the male tab contacting portion and bent in the lower center portion (namely lower bent end) of the peripheral wall to extend upwards therefrom, wherein the interfering projection enters into a space between the slanted portion and the front wall of the peripheral wall when the terminal is properly inserted, and abuts against the upper or lower bent end of the resilient contacting portion when not inserted properly.

Still further, it will be preferable if the interfering projection is constructed as a horizontally extended but slightly narrower than the space between the opposite wall portions of the peripheral wall.

If the terminal is properly inserted, the interfering projection formed in the terminal accommodating section enters into a space between the resilient contacting portion and the peripheral wall, and thus no interference occurs between the terminal and the interfering projection. If the terminal is rotated for an angle of 180° in the peripheral direction thereof and inserted into the terminal accommodating section, the upper bent end portion of the resilient contacting portion abuts against the interfering projection to hamper the perfect insertion of the terminal. On the other hand, if the terminal is inserted upside down, the lower bent end portion of the resilient contacting portion abuts against the interfering projection. Still further, if the terminal is rotated for an angle of 90° in the peripheral direction thereof and inserted into the terminal accommodating section, the upper bent end portion abuts against one end of the horizontally extended interfering projection, and the lower bent end portion abuts against the central portion of the interfering projection, to respectively hamper the perfect insertion of the terminal.

Other features and advantages of the invention will be apparent from the following description taken in connection with the accompanying drawing.

DETAILED DESCRIPTION OF THE PREFERRED EMBODIMENTS

Figure 1:
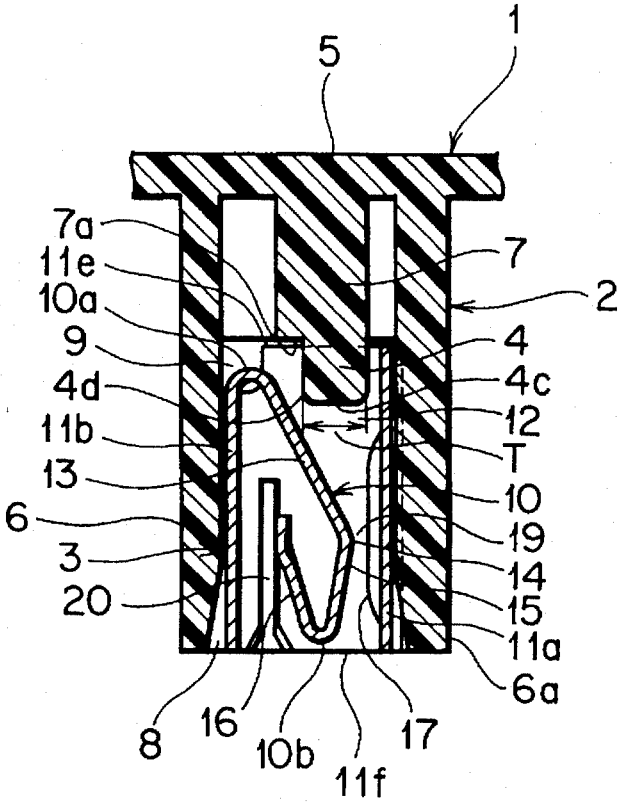
FIG. 1 is a longitudinal sectional view showing a wrong insertion prevention structure for a terminal as one embodiment of the present invention.
Figure 2:
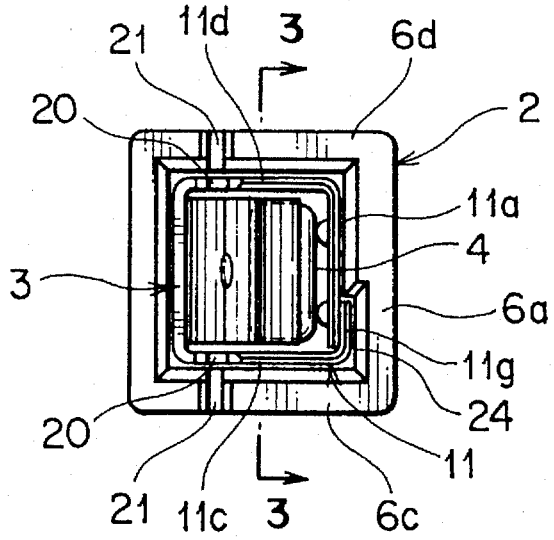
FIG. 2 is a bottom plan view of the structure shown in FIG. 1.
Figure 3:
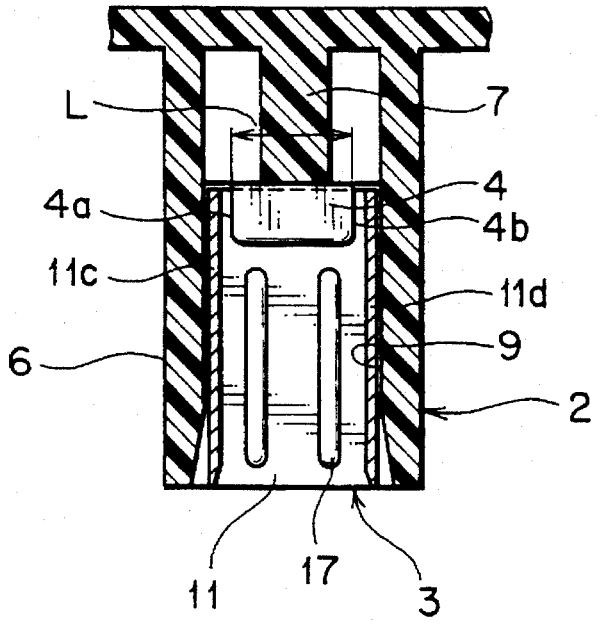
FIG. 3 is a sectional view of the structure observed from the line 3—3 of FIG. 2.

In the following, several embodiments of the present invention are described with reference to the accompanying drawings, wherein FIGS. 1 to 3 illustrate one embodiment of the present invention.

In the figures, it is shown that an interfering projection 4 for preventing a wrong insertion of a coupling terminal 3 is formed in a terminal accommodating section 2 of an upper casing 1 of a conventionally used ordinary electrical junction box. The terminal accommodating section 2 is, as conventionally done, made of synthetic resin, and is formed such that a peripheral wall 6 of a substantially rectangular tube shape is extended downwardly from the upper wall 5 of the upper casing 1, while inside the peripheral wall 6 a stopping wall 7 is also extended downwardly from the upper wall 5, and formed under the stopping wall 7 is an accommodating chamber 9 having a lower opening 8. The interfering projection 4 is integrally and protrudedly formed from the lowermost end 7*a* of the stopping wall 7 directing toward the terminal accommodating chamber 9.

The interfering projection 4 is formed in a horizontally rectangular parallelopiped shape, and is eccentrically disposed rather toward one side wall (front wall) of the peripheral wall 6 from the center of the accommodating chamber 9 in the direction of T which is a width of the interfering projection 4 in such a way that the center thereof in the direction of the length L coincides with the center of the terminal accommodating chamber 9.

In other words, as shown in FIG. 1, the interfering projection 4 enters into a conventionally used coupling terminal 3 which has been properly inserted into the terminal accommodating section 2, and protrudes into a space 12 between the resilient contacting portion 10 of the coupling terminal 3 and the front wall 11*a* of the peripheral wall 11 facing against the resilient contacting portion 10. Further, as shown in FIGS. 2 and 3, the opposite longitudinal end portions 4*a*, 4*b* of the interfering projection 4 enters between the opposite wall sections 11*c* and 11*d* and stopped therebetween leaving a slight gap. In other words, the coupling terminal 3 is inserted into the terminal accommodating section 2 without abutting against the interfering projection 4 when it is properly inserted.

As shown in FIG. 1, the coupling terminal 3, which is same as the conventionally adopted one, is constructed such that the resilient contacting portion 10 is bent downward near the upper end of the rear wall section 11*b* of the peripheral wall 11 of a rectangular tube shape. The resilient contacting portion 10 is composed of a male tab contacting section 15 having a slanted portion 13 extending from the upper end of the rear wall 11*b* through the upper bent end portion 10*a* toward the front wall section 11*a* and having a contacting summit 14 continued from the slanted portion 13, and of a busbar contacting section 16 which extends upward from the lower bent end portion 10*b* of the male tab contacting section 15.

Figure 4:
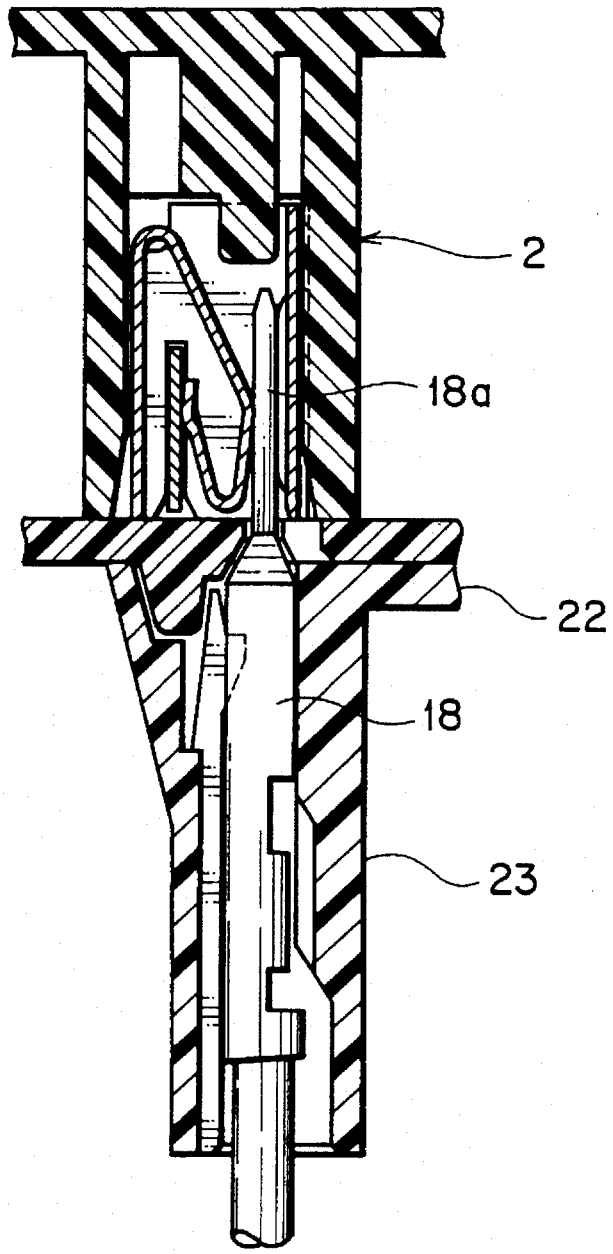
FIG. 4 is a longitudinal sectional view showing a state that the terminal is inserted and connected.

Provided between the male tab contacting section 15 and a protruded contacting rib 17 formed on the front wall 11*a* is an insertion gap 19 for receiving the male tab 18*a* of the male terminal 18 as shown in FIG. 4, and a busbar receiving groove 20 is provided at the respective opposite wall sections 11*c* and 11*d* of the peripheral wall 11, which busbar receiving groove 20 is further connected with a groove 21 formed at the respective side walls 6*a* and 6*d* of the terminal accommodating section 2. The male terminal 18 is mounted to a receiving section 23 of the lower casing 22.

As shown in FIG. 1, the upper bent end portion 10*a* of the resilient contacting portion 10 is held a bit lower than the upper end surface 11*e* of the peripheral wall 11, wherein when the terminal 3 is properly inserted in the terminal accommodating section 2, the lower bent end portion 10*b* of the resilient contacting portion 10 is held in the substantially central position at the lower end portion of the terminal accommodating section 2, and also a bit upper than the lowermost surface 11*f* of the peripheral wall 11. In FIG. 1, a rear corner section 4*d* of a free end portion 4*c* of the interfering projection 4 is held at a position having a small gap from the opposing slanted portion 13 of the resilient contacting portion 10.

In FIG. 2, the coupling terminal 3 comprises an overlapped portion 11*g* on the peripheral wall 11 as is provided in a conventional one, and the terminal accommodating section 2 comprises a relief groove 24 for receiving the overlapped portion 11*g*, but it can also be constructed without these members 11*g* and 24 in the present invention. In fact, even though the overlapped portion 11*g* is not fitted in the relief groove 24 to be aligned with each other, if the orientation of the terminal is incorrect, the coupling terminal 3 cannot be inserted perfectly as the interfering projection 4 abuts against it.

FIGS. 5 to 9 show various states in which the interfering projection 4 and the coupling terminal 3 are abutted against each other due to an improper insertion of the terminal 3.

Figure 5:
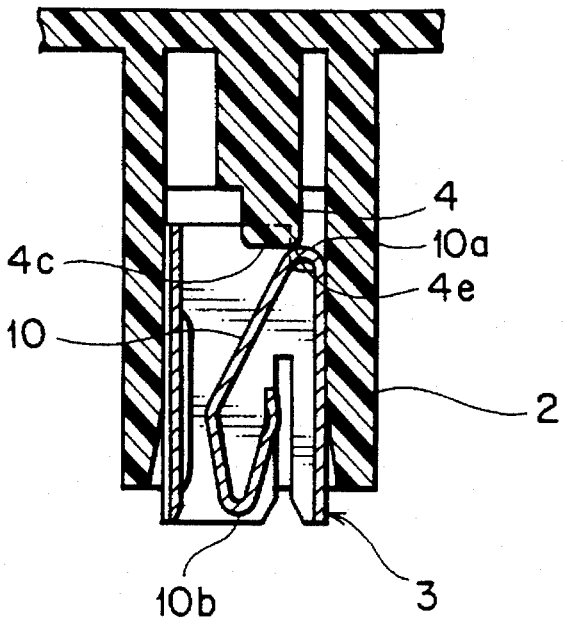
FIG. 5 is a longitudinal sectional view showing a state that the terminal is rotated for an angle of 180° in the peripheral direction thereof before inserted.

FIG. 5 shows a case that the coupling terminal 3 is rotated for an angle of 180° in the peripheral direction contrary to the properly inserted case, wherein the upper bent end portion 10*a* of the resilient contacting portion 10 of the coupling terminal 3 abuts against the corner portion of the free end 4*c* of the interfering projection 4 within the terminal accommodating section 2 and thus the insertion of the terminal 3 is hampered. The upper bent end portion 10*a* abuts against the interfering projection 4 uniformly in the longitudinal direction thereof.

Figure 6:
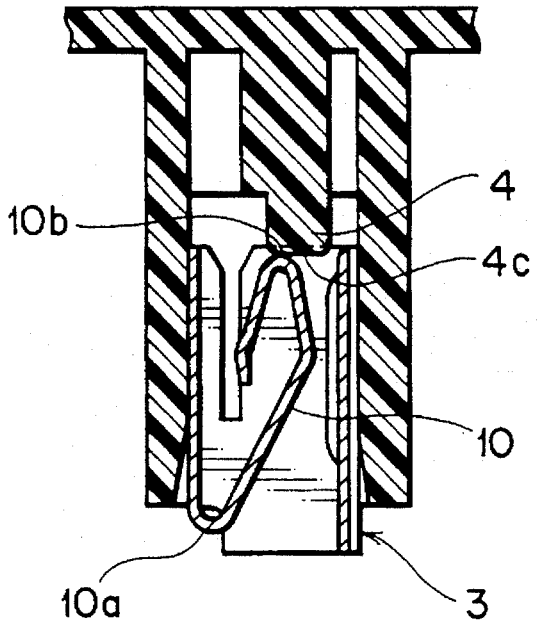
FIG. 6 is a longitudinal sectional view showing a state that the terminal is inserted upside down.
Figure 7:
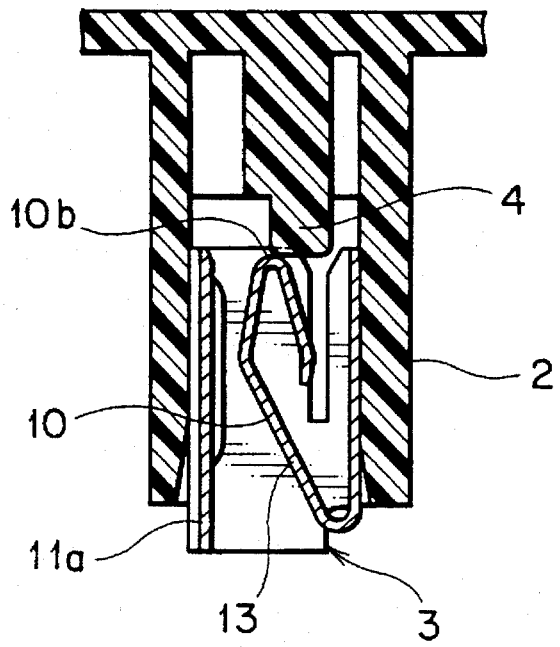
FIG. 7 is a longitudinal sectional view showing a state that the terminal is rotated for an angle of 180° in the peripheral direction thereof before inserted from the state of FIG. 6.

FIG. 6 shows a case that the coupling terminal 3 is inserted upside down, wherein the lower bent end portion 10*b* of the resilient contacting portion 10 abuts against the rear side of the free end 4*c* of the interfering projection 4. FIG. 7 shows a case that the coupling terminal 3 is rotated for an angle of 180° in the peripheral direction from its position indicated in FIG. 6 contrary to the properly inserted case, wherein the lower bent end portion 10*b* of the resilient contacting portion 10 of the coupling terminal 3 abuts against the rear side of the interfering projection 4. This is due to the fact that the lower bent end portion 10*b* of the resilient contacting portion 10 is located in the central portion of the terminal accommodating section 2, and also the interfering projection 4 is, as disclosed in FIG. 1, located rather toward the front side of the terminal accommodating section 2 so as to be inserted in a gap 12 between the slanted portion 13 of the resilient contacting portion 10 and the peripheral wall 11*a*.

Figure 8:
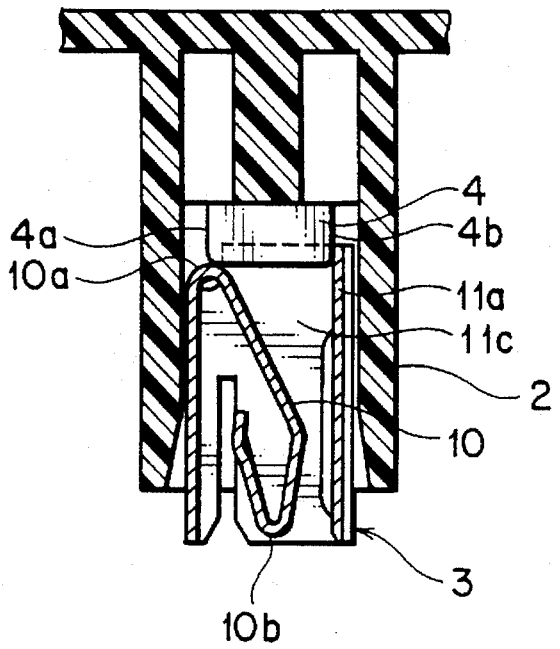
FIG. 8 is a longitudinal sectional view showing a state that the terminal is rotated for an angle of 90° in the peripheral direction thereof before inserted.

FIG. 8 shows a state that the coupling terminal 3 is rotated for an angle of 90° in the peripheral direction contrary to the properly inserted state of FIG. 1 (the orientation of the terminal accommodating section 2 corresponds to that in FIG. 3), wherein the upper bent end portion 10*a* of the resilient contacting portion 10 abuts against a corner portion 4*a* of the interfering projection 4 in the longitudinal direction thereof. In fact, the upper end portion 10*a* intersects with the longitudinal portion of the interfering projection 4. Since the side wall section 11*c* of the coupling terminal 3 is made narrower than the front wall section 11*a* thereof, the front wall section 11*a* is normally held just adjacent to the other side end 4*b* of the interfering projection 4, but there can be a case in which the upper end of the front wall section 11*a* directly abuts against the side end 4*b* of the interfering projection 4 in accordance with an inconsistency of the dimension of the coupling terminals. Even in the case that the coupling terminal 3 is rotated for an angle of 180° in the peripheral direction, the mutual abutting state between the interfering projection 4 and the coupling terminal 3 remains the same.

Figure 9:
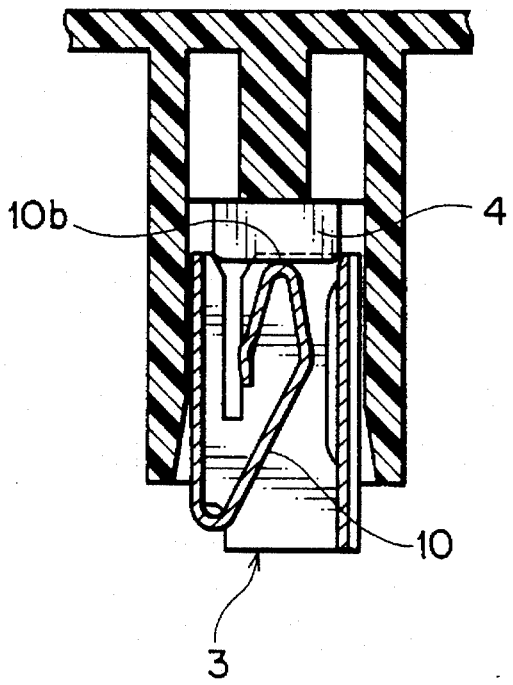
FIG. 9 is a longitudinal sectional view showing a state that the terminal is inserted upside down from the state of FIG. 8.
Figure 10:
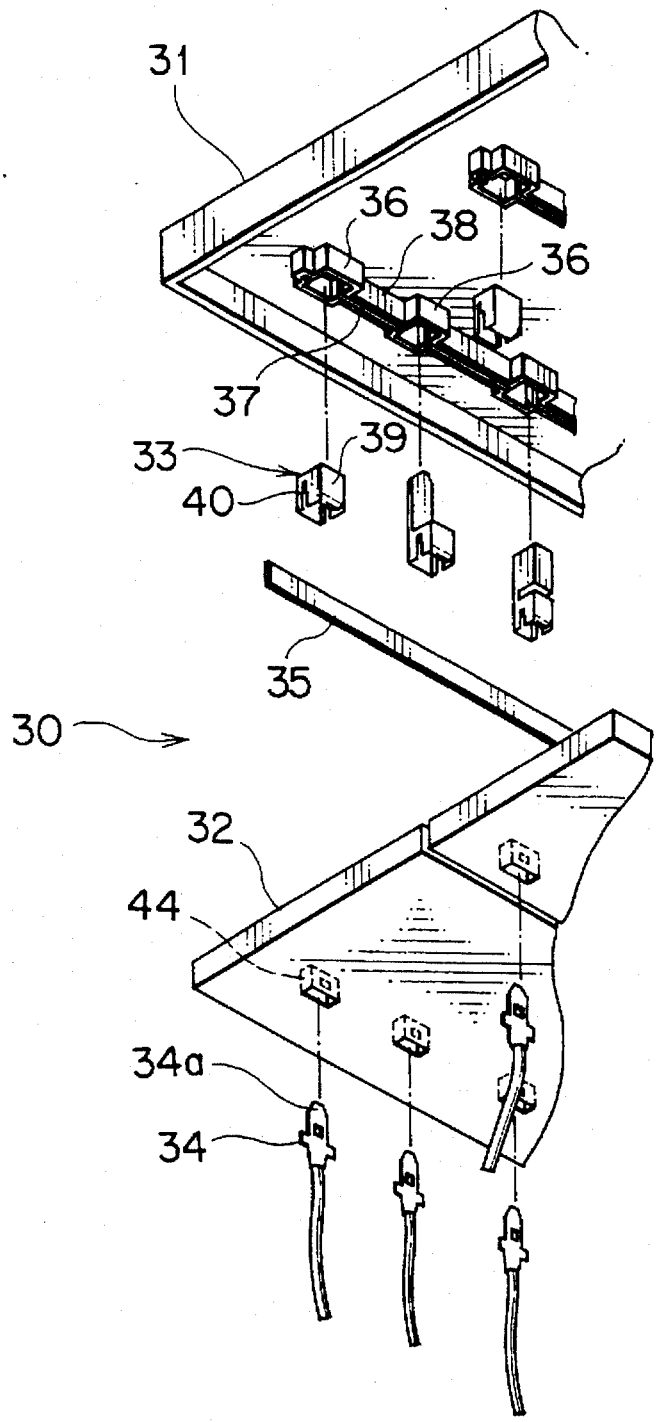
FIG. 10 PRIOR ART
FIG. 10 is an exploded perspective view showing a conventional electrical junction box.
Figure 11:
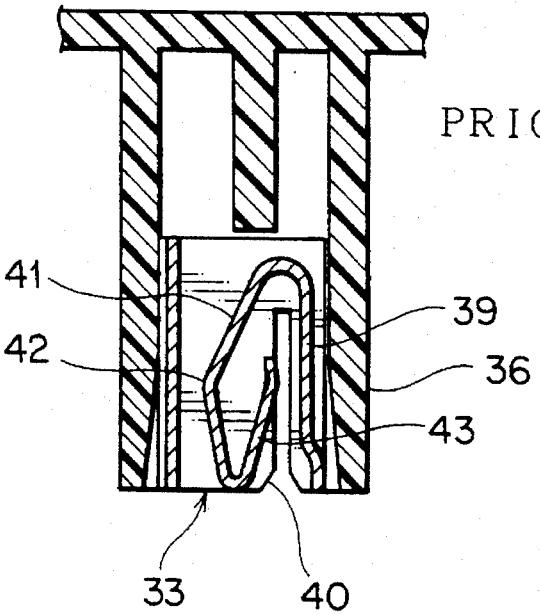
FIG. 11 is a longitudinal sectional view of FIG. 10 showing a state that the terminal is received in the terminal accommodating section.
Figure 12:
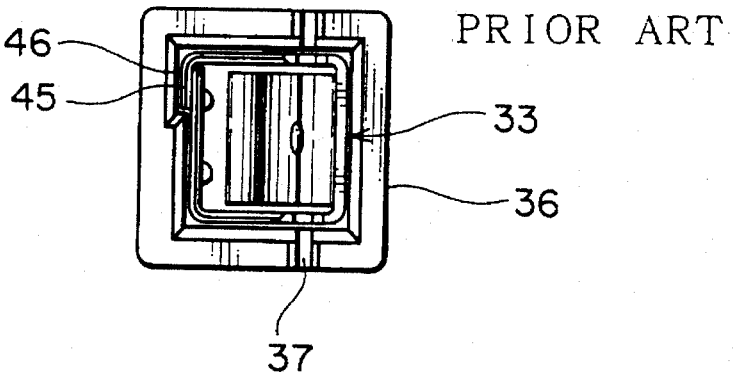
FIG. 12 is a bottom plan view of FIG. 11.
Figure 13:
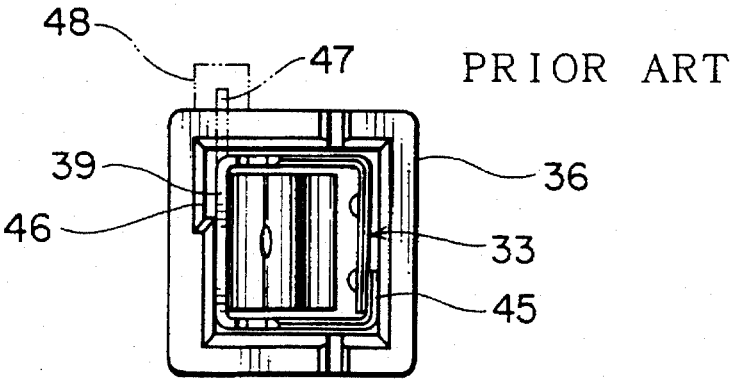
FIG. 13 is a bottom plan view showing a state that the terminal is rotated for an angle of 180° in the peripheral direction thereof before inserted.

FIG. 9 shows a case that the coupling terminal 3 is inserted upside down against the situation of FIG. 8, wherein the lower bent end portion 10*b* of the resilient contacting portion 10 abuts against the interfering projection 4 in the longitudinal central portion thereof, and this relation remains the same even though the coupling terminal 3 is further rotated for an angle of 180° from the situation of FIG. 9.

It is to be noted that an application of this wrong insertion prevention structure for a terminal is not limited only to electrical junction boxes, but can be applied to a terminal accommodating section of a connector or the like.

Effect of the Invention

As explained heretofore, according to the present invention, even if the terminal is inserted into a terminal accommodating section in an improper manner such as in a reversed state or the like, an interfering projection formed in the terminal accommodating section abuts against the resilient contacting portion of the terminal to stop the insertion thereof in the middle way, so that the wrong insertion can be prevented. Specially, if the terminal is provided both with an upper bent end and lower bent end portions in the resilient contacting portion, the interfering projection abuts against the upper bent end portion and the lower bent end portion, respectively in the case that the terminal is inserted after being rotated for an angle of 180°, in the peripheral direction thereof and in the case that it is inserted upside down, whereby wrong-orientated insertions of terminal can be avoided. Further, if the interfering projection is formed as having a horizontally extended portion, even though the terminal is rotated for an angle of 90° in the peripheral direction thereof, either lower or upper bent end portion abuts against the interfering projection in the longitudinal direction thereof, so that no wrong-orientated insertion of terminal can be permitted.

Furthermore, since any erroneous insertion of terminal can be prevented by a structure of the present invention, a conventionally required groove formed in a terminal accommodating section side for receiving an overlapped portion of the peripheral wall of the terminal is no longer needed, and still further, neither a protruded section for regulating the orientation of the terminal in the peripheral wall of the terminal nor a groove in the terminal accommodating section for receiving the protruded section is needed any longer, whereby an enlargement of an electrical junction box, connector and so on provided with a terminal accommodating section, and a deterioration of distribution efficiency of a circuit due to the reduction of inner space therein can be efficiently avoided, and in addition, a deterioration of an yield in the material prepared for manufacturing the terminal and that of a handling efficiency due to a mutual entanglement of terminals can also be avoided simultaneously.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. A wrong insertion prevention structure for a terminal for leading a terminal formed with a first peripheral wall of a substantially rectangular tube and having a resilient contacting portion therein into a corresponding terminal accommodating section formed in an electrical junction box, wherein said terminal accommodating section further comprises;

a second peripheral wall, a stopping wall formed within said second peripheral wall, and an interfering projection integrally and protrudingly formed on the lowermost end of said stopping wall directing downward, wherein said interfering projection enters into a space between said resilient contacting portion and said first peripheral wall when the terminal is properly inserted, and abuts against said resilient contacting portion when the terminal is not inserted properly.

2. A wrong insertion prevention structure for a terminal as claimed in claim 1, wherein said interfering projection is formed in a horizontally rectangular parallelopiped shape, and disposed eccentrically toward one side of said second peripheral wall from the center of said terminal accommodating section.

3. A wrong insertion prevention structure for a terminal as claimed in claim 1, wherein said resilient contacting portion further comprises;

a male tab contacting portion having a slanted piece which is bent near the upper end of a rear wall of said first peripheral wall, forming an upper bent end portion, and slanted downward, and a busbar contacting portion which is a continuation from said male tab contacting portion and bent in a lower center portion of said first peripheral wall to extend upwards therefrom, forming a lower bent end portion, wherein said interfering projection enters into the space between the slanted portion and a front wall of said first peripheral wall when the terminal is properly inserted, and abuts against the upper or lower bent end of said resilient contacting portion when not inserted properly.

4. A wrong insertion prevention structure for a terminal as claimed in claim 3, wherein said interfering projection is formed extendedly in such a form as to be slightly narrower than the space between opposite wall portions of said first peripheral wall.

* * * * *